United States Patent [19]

Jahoda

[11] Patent Number: 4,998,719

[45] Date of Patent: Mar. 12, 1991

[54] JUDO TRAINING DEVICE

[76] Inventor: Frantisek Jahoda, Am Schreiberg 7, A-5201 Seekirchen, Austria

[21] Appl. No.: 277,676

[22] Filed: Nov. 29, 1988

[51] Int. Cl.[5] ..... A63B 69/00

[52] U.S. Cl. ..... 272/76; 446/247

[58] Field of Search ..... 272/76, 77, 78, 74, 272/93, 146; 446/46, 247; 273/55 R, 55 A; 119/29; 441/56, 58

[56] References Cited

U.S. PATENT DOCUMENTS

| | | | |
|---|---|---|---|
| 665,980 | 1/1901 | Roche | 446/247 |
| 1,040,851 | 10/1912 | Berg | 272/107 |
| 1,481,594 | 1/1924 | Fitzgerald | 272/76 |
| 2,194,736 | 3/1940 | De Bruler | 119/29 |
| 3,612,520 | 10/1971 | Chang | 272/146 |
| 4,165,580 | 8/1979 | Miura | 446/46 |
| 4,273,327 | 6/1981 | Nall et al. | 272/146 |
| 4,801,140 | 1/1989 | Bergeron | 272/146 |

*Primary Examiner*—Stephen R. Crow

*Attorney, Agent, or Firm*—Collard, Roe & Galgano

[57] ABSTRACT

A training device for use in the sport of judo has a circular bottom surface curving upwardly, and a top part tapering inwardly and upwardly. The training device consists of an elastic material and it is symmetrical about its axis. In particular, the curvature of the flat part and the resulting line of the tapered top part are adapted to the anatomy of the foot, in particular, to the length of the foot and the shape of the instep. This device simplifies the practice of ASHI-WAZA.

7 Claims, 2 Drawing Sheets

JUDO TRAINING DEVICE

BACKGROUND OF THE INVENTION

1. Field of the Invention

The invention relates to a training device for the sport of judo. More particularly, the invention relates to a training device for exercising the ASHI-WAZA leg sweeping techniques, which are important in the sport of judo, but nevertheless are neglected in most training systems.

2. Description of the Prior Art

It is not possible for beginners, particularly children, to immediately have the skill necessary for exercising ASHI-WAZA leg sweeping techniques on a partner. Therefore, it is useful for these techniques to be first practiced on an object lying on the mat. For this purpose, many trainers use small paper balls, cut tennis balls or small pieces of wood. The objects used to date are not satisfactory, both with respect to the frictional resistance, i.e., they easily roll away, and with respect to safety, i.e., if wooden blocks are used. Furthermore, the prior art practice objects are not particularly attractive, especially to children, to encourage exercise of the Ashi-techniques in a playful manner.

SUMMARY OF THE INVENTION

It is therefore an object of the invention to provide a training device for ASHI-WAZA techniques.

It is an additional object of the invention to provide a training device for ASHI-WAZA leg sweeping techniques which resembles a foot and can be suspended from an individual's torso during practice.

It is yet an additional object of the invention to provide a training device for ASHI-WAZA leg sweeping techniques which is simple in design, inexpensive to manufacture, and which encourages the exercise of the techniques in a playful manner.

Accordingly, these and related objects are accomplished by a judo training device, which includes an elastic body having a centrally located axis therethrough and having a circular bottom surface curving upwardly. The device further includes a circular top part formed on an upper portion of the elastic body attached to a circular bottom portion. The top part tapers upwardly and inwardly therefrom towards the central axis. The device is circular and is symmetrical about the central axis. The curvature of the circular bottom portion and the resulting inwardly tapered line of the circular top part form to the shape of a foot. The elastic body may be made hollow and filled with weights to simulate an actual foot with the weight of the body pressing down thereon. The device may be made in two parts, with the to and bottom part bonded.

The training device, according to the present invention, because of its shape and material, offers the required resistance for carrying out the special ASHI-WAZA exercises on a judo mat and, furthermore, has a relatively low weight. Its shape is approximately the shape of a foot and, therefore, a real representation of the foot of a training partner. This is highly desirable since exercising with the device is followed by actual training with a partner. The device may be suspended on a cord or can be fastened on the garment (belt) of the trainee, or held by the hand. This makes possible continuous training, as the training device returns, after each successful action, to its starting position between the feet of the trainee. The soft, rounded material of the training device prevents injury, even if the trainee falls on it; its shape forces the latter to have his foot in the correct positions when sweeping, and in particular, entices children and teenagers to practice the sweeping techniques.

These and other objects and advantages of the present invention will become apparent from the following description of the accompanying drawings, which disclose several embodiments of the invention. It is to be understood that the drawings are to be used for the purposes of illustration only, and not as a definition of the invention.

BRIEF DESCRIPTION OF THE DRAWINGS

In the drawings, wherein similar reference numerals denote similar elements throughout the several views.

DESCRIPTION OF THE PREFERRED EMBODIMENTS

Figure 1:
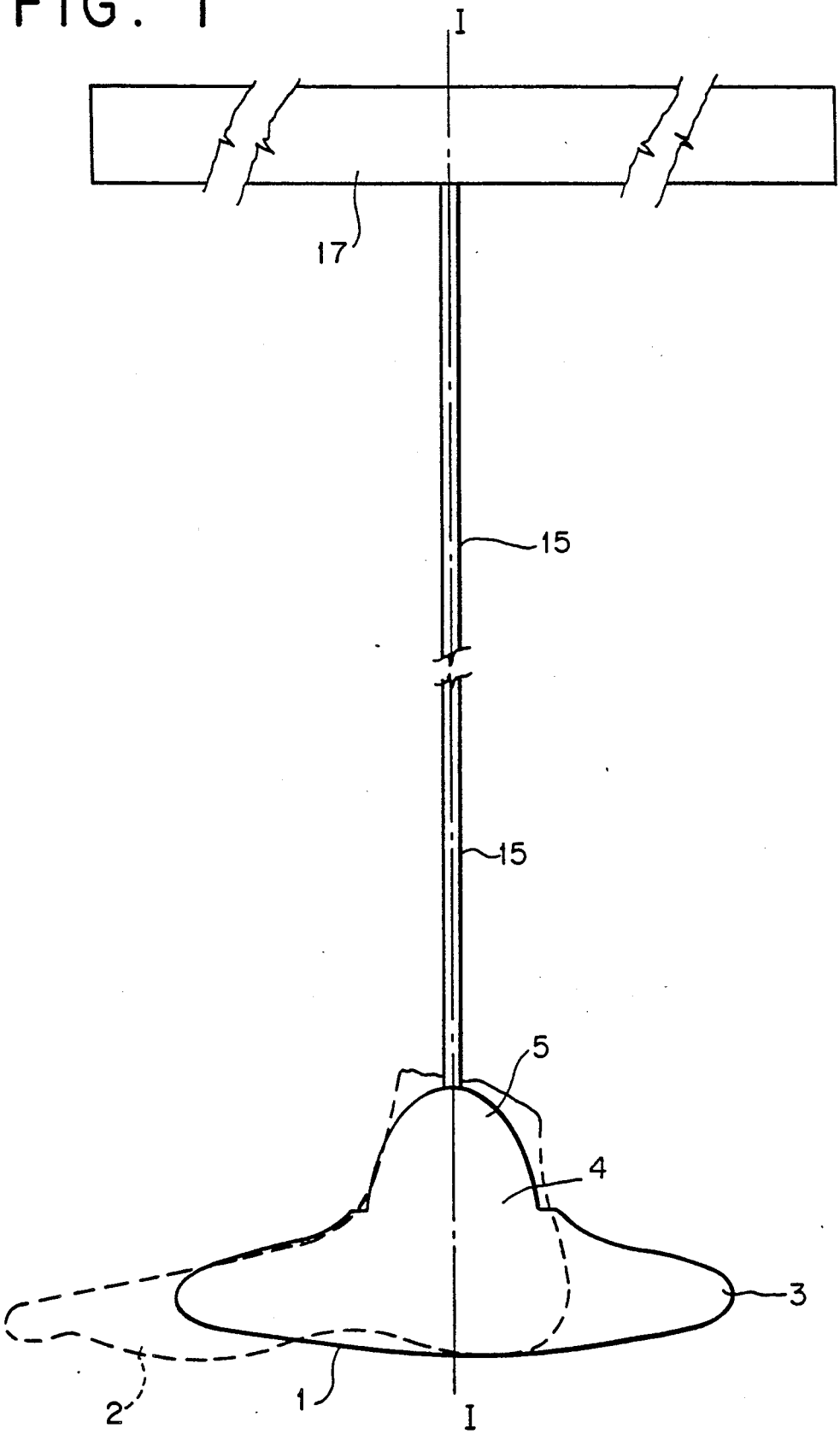
FIG. 1 shows a training device, according to the invention, suspended from a cord fastened to a user's belt, and superimposed on the silhouette of a human foot.

Referring to the figures, there is shown a training device, generally denoted as 1', which can also be called a judo ball, having an outer surface formed as a surface of revolution of a typical instep, which is symmetrical with respect to axis I—I. When viewed from the top, training device 1' has a circular or disk shape and has a bottom surface 1 that is curved only slightly at the edge, and which is made in such a way that the training device offers a defined frictional resistance when sliding across a judo mat. This resistance is approximately the same as that resistance produced by an individual's leg conforming to the size of the trainee in a walking motion. The frictional resistance produced is also dependent upon the material of the judo mat, the size of the bottom surface 1 resting on the mat, and the material of training device 1'. Training device 1' is made from an elastic material, such as rubber, or an elastic plastic material. For increasing the frictional resistance, an additional coating or covering 20 may be permanently or removably applied to bottom surface 1, which could also have an embossed or textured structure (the embossed structure is not shown in the drawings).

Figure 2:
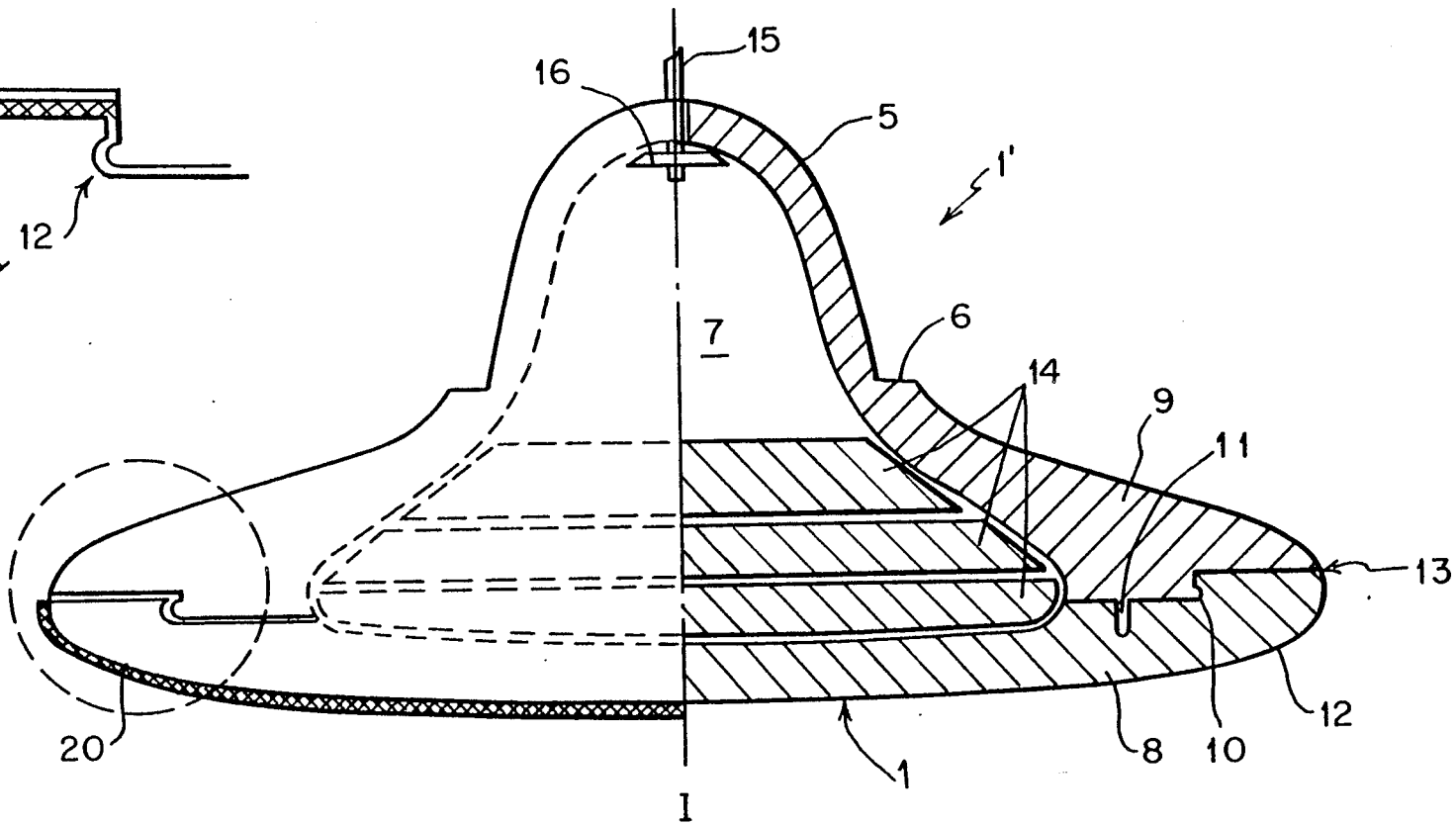
FIG. 2 shows an enlarged elevation view of the training device without the cord, partly in cross section.
Figure 2A:
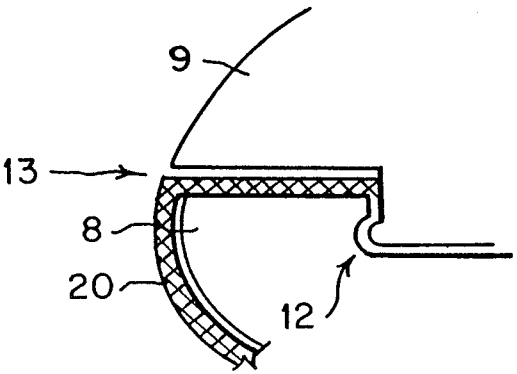
FIG. 2*a* is an enlarged view of the circled area of the joint between top and bottom parts shown in FIG. 2.

In cross section, as shown in FIG. 2, the top part of training device 1' is shaped in the form of a human foot 2 (shown as a dotted line), having a flatter outer part 3 conforming to the instep or front of the foot. A curved part 4, having a smaller radius tapering inwardly and upwardly, conforming to the transition from the foot to the leg, and finally a rounded dome 5 are also provided.

Provision is made for a ledge or step 6 in the transition zone between the flat marginal part 3 and the curved part 4 for facilitating the handling of the training device. Instead of a ledge or step 5, provision may be made for local indentations (not shown in the drawing), so that the training device may be held with the finger tips, in which case such indentations are sized accordingly. Preferably, the training device has a hollow interior space 7, which permits the manufacture of training devices 1' which are very low in weight.

Furthermore, training device 1 may be made in two parts, for example, a bottom bowl shaped part 8 and a top cover part 9. Bottom 8 and top cover 9 may have circular projections or recesses 10 and/or centering pins and the matching holes 11 on their contact surfaces. Bottom 8 and top cover 9 may be joined by a screw connection (not shown) or by any type of interlocking snap connection, for example, such as the circular groove on the bottom part 8 which is snapped over a tongue on top part 9 and spring connections 12 for assuring a safe joint and preventing unintentional separation. In addition to offering advantages in the manufacture of the device, forming training device 1' in two parts has other advantages, for example, installing coatings in joint 13 for increasing the frictional resistance between the two parts. These coatings are clamped in the joint and may be the edge of covering 20 which is held in position on bottom part 8 by the clamping action. Weights 14 then may also be installed in hollow space 7, which increases the frictional resistance and the force to be applied in the sweeping motions. Weights 14, for example, may be disks adapted to successively fill up hollow space 7 until a sufficient weight is reached.

A cord 15, which preferably is elastic, is fastened in the dome 5 along the central axis I—I. The length of the cord 15 is adapted to the size of the trainee. If device 1' is made in two parts and can be divided, the cord may be pulled into hollow space 7 and fixed therein, for example, by means of a clamp 16 in such a way that it will have the desired length. For static exercises, a training device without a cord or with the cord removed, should be used. The top end of cord 15 can be fastened, for example, on the belt 17 of the trainee, or on the belt of the training partner, as well, and held in the right or left hand for performing special exercises.

Due to the training device having an axially symmetrical disk-shaped form, the training device offers identical training or exercising possibilities from each side, irrespective of its position, which is important particularly for starting combinations of techniques.

The preferred training device 1' has a diameter of 175 mm and a height of 82 mm. The curvature of the device conforms to the average foot of a child in the five to nine year age group. The bevel or slope in the ascending part simulates the instep of a child's foot.

As sweeping motions are performed by the trainee, which motions have to be carried out with the slightly bent inner side of the sole of the foot, the device applies a defined frictional resistance to the judo mat. This resistance conforms approximately to the frictional resistance of the non-loaded foot of a child. Also, the device can be dropped from the level of the hip, whereby the trainee can improve his reaction with the sweeping leg because the movement required so that the device can be swept just before it impacts the ground or mat has to be estimated and exploited. This is because the device will bounce away due to its elasticity, if, during this exercise, it is hit too late or too early. This exercise is particularly helpful for improving good leg reactions.

While several embodiments and examples of the present invention have been illustrated and described, it is obvious that many changes and modifications may be made thereunto, without departing from the spirit and scope of the invention.

What is claimed is:

1. A judo training device comprising:

an elastic body having a centrally located axis therethrough and having a circular bottom part curving upwardly; said bottom part having a large radius of curvature;

a circular top part formed as an upper portion of said elastic body and tapering upwardly and inwardly from said circular bottom portion towards said central axis; said top part having a radius of curvature smaller than the bottom part;

an intermediate portion connecting said top part to said bottom part, said intermediate portion comprising (a) a first curved end attached to said bottom part with the first curved end being convex shaped, (b) a second curved end attached to said top part with the second curved end being concave shaped, and (c) a straight section connecting said first curved end to said second curved end;

said body having an elastic cord exiting from said top part;

said bottom part being provided with a friction covering on a bottom surface thereof for increasing the sliding friction on a judo mat; and wherein the curvature of the circular bottom portion part and the resulting line of the tapered top part conform to the shape of the foot;

whereby a judo trainee can move his leg to sweep the judo training device during practice therewith to learn judo sweeping motions.

2. The judo training device, as set forth in claim 1, wherein said body in symmetrical about said central axis.

3. The judo training device, as set forth in claim 1, wherein said body is hollow.

4. The judo training device, as set forth in claim 1, wherein said elastic body is in two parts with said bottom part fixedly connected to said circular top part.

5. The judo training device, as set forth in claim 1, wherein said body has a small gripping ledge on said circular top part, to aid a trainee in gripping the device during the use thereof.

6. The judo training device, as set forth in claim 1, wherein the friction covering is removable and replacable.

7. The judo training device, as set forth in claim 1, further including weights arranged within said body.

* * * * *